US005655690A

United States Patent [19]

DeGoler et al.

[11] Patent Number: 5,655,690

[45] Date of Patent: Aug. 12, 1997

[54] APPARATUS FOR DISPENSING PRODUCT THROUGH A VERTICAL DISPENSER TUBE

[76] Inventors: Warren H. DeGoler; Terry E. Joynes, both of 1051 S. 23rd St., Omaha, Nebr. 68108

[21] Appl. No.: 443,780

[22] Filed: May 18, 1995

[51] Int. Cl.[6] ..... B67D 3/00

[52] U.S. Cl. ..... 222/380; 141/68; 141/99; 141/256; 222/412; 222/504; 222/559; 222/129

[58] Field of Search ..... 222/135, 129, 222/138–142, 412, 380, 504, 559, 413; 141/99, 68, 255–257

[56] References Cited

U.S. PATENT DOCUMENTS

| | | | |
|---|---|---|---|
| 2,640,630 | 6/1953 | Genco | 222/559 X |
| 3,054,533 | 9/1962 | Kurek | 222/504 X |
| 3,246,808 | 4/1966 | Lidell et al. | 222/504 X |
| 3,648,904 | 3/1972 | Teige | 222/380 |
| 4,235,265 | 11/1980 | Feliks | 222/380 X |
| 4,911,332 | 3/1990 | King | 222/142 |
| 5,097,993 | 3/1992 | Davis | 222/559 X |
| 5,137,187 | 8/1992 | Nichols et al. | 222/559 X |
| 5,228,604 | 7/1993 | Zanini et al. | 222/504 |
| 5,287,997 | 2/1994 | Rodrique et al. | 222/380 |
| 5,553,756 | 9/1996 | Topper et al. | 222/380 X |

*Primary Examiner*—Kevin P. Shaver

*Attorney, Agent, or Firm*—Zarley, McKee, Thomte Voorhees & Sease; Mark D. Frederiksen

[57] ABSTRACT

A dispensing apparatus includes a first vertical tube with a plug operably mounted in the lower end to selectively prevent the flow of the material from a dispensing opening in the lower end of the tube. A horizontal feed tube has an auger therein which selectively moves material into the upper end of the vertical tube for dispensing through the dispensing opening of the vertical tube. An actuator mounted on the vertical tube selectively moves the plug between the open and closed positions to dispense material within the tube. A second vertical tube adjacent the first tube also includes a plug operably mounted in a dispensing opening in the lower end thereof, for dispensing fluid from the second vertical tube. The first vertical tube is mounted with its lower end vertically spaced above the lower end of the second vertical tube such that liquid from the second vertical tube will not spray on the first vertical tube.

19 Claims, 4 Drawing Sheets

APPARATUS FOR DISPENSING PRODUCT THROUGH A VERTICAL DISPENSER TUBE

TECHNICAL FIELD

The present invention relates generally to apparatus for dispensing material within a container, and more particularly to an improved dispensing apparatus and method for dispensing a dry particulate material and a liquid within a container.

BACKGROUND OF THE INVENTION

The manufacture of packages of "gel packs" having a chemical compound within a plastic package which retains thermal energy to provide a long term heating element or cooling element, is typically accomplished in one of two ways. First, the chemical compound or "gel" is premixed and injected in gel form into the open top of a package. The package is then sealed and conveyed for marketing. In a second method of packaging a gel pack, a dry particulate material is mixed with a liquid directly within an open topped package, and the package is then sealed and conveyed to a storage area. The liquid and particulate mix to form the desired gel product while sealed within container.

The major problem with prior art dispensing apparatus which dispense both liquid and dry materials within a package, is in the dispensing of the dry materials within the package. First, prior art apparatus utilize a vertically oriented auger to dispense the dry crystals into the package. Such augers are expensive pieces of equipment, and suffer several problems. First, vertical augers do not provide the desired accuracy in dispensing the dry crystals in the package, to obtain a consistent mixture in each package. Second, the open lower end of a vertical auger does not prevent liquid from reaching the interior of the "dry tube", thereby causing clumping or accumulation of crystals at the lower end of the dry tube, and affecting the dispensing of further dry crystals into each package.

In addition, prior art dispensing apparatus were not capable of easily changing the amount of dry crystal material added to a package, thereby restricting the flexibility of the dispensing apparatus.

SUMMARY OF THE INVENTION

It is therefore a general object of the present invention to provide an improved dispensing apparatus for dispensing a dry particulate material into a container.

A further object of the present invention is to provide an improved dispensing apparatus with a first vertical tube for dry materials and a second vertical tube for liquid, the tubes having lower ends positioned within a package to prevent splashing of liquid up into the dry tube.

Still another object is to provide a dispensing apparatus with a horizontal feed auger to the dry tube and an operable plug for dispensing precise amounts of dry material into the package.

Yet another object of the present invention is to provide an improved dispensing apparatus with a wet tube which positively seals upon the dispensing of each quantity of liquid into a container.

Another object is to provide a dispensing apparatus which prevents caking or clumping of dry material on the end of the dry tube during dispensing of dry and liquid products into a container.

A further object of the present invention is to provide a dispensing apparatus which is economical to manufacture and simple to operator.

Yet a further object of the present invention is to provide an improved method for dispensing liquid and dry particulate material into a package.

These and other objects will be apparent to those skilled in the art.

The dispensing apparatus of the present invention includes a first vertical tube with a plug operably mounted in the lower end to selectively prevent the flow of the material from a dispensing opening in the lower end of the tube. A horizontal feed tube has an auger therein which selectively moves material into the upper end of the vertical tube for dispensing through the dispensing opening of the vertical tube. An actuator mounted on the vertical tube selectively moves the plug between the open and closed positions to dispense material within the tube. A second vertical tube adjacent the first tube also includes a plug operably mounted in a dispensing opening in the lower end thereof, for dispensing fluid from the second vertical tube. The first vertical tube is mounted with its lower end vertically spaced above the lower end of the second vertical tube such that liquid from the second vertical tube will not spray on the first vertical tube.

DESCRIPTION OF THE PREFERRED EMBODIMENT

Figure 1:
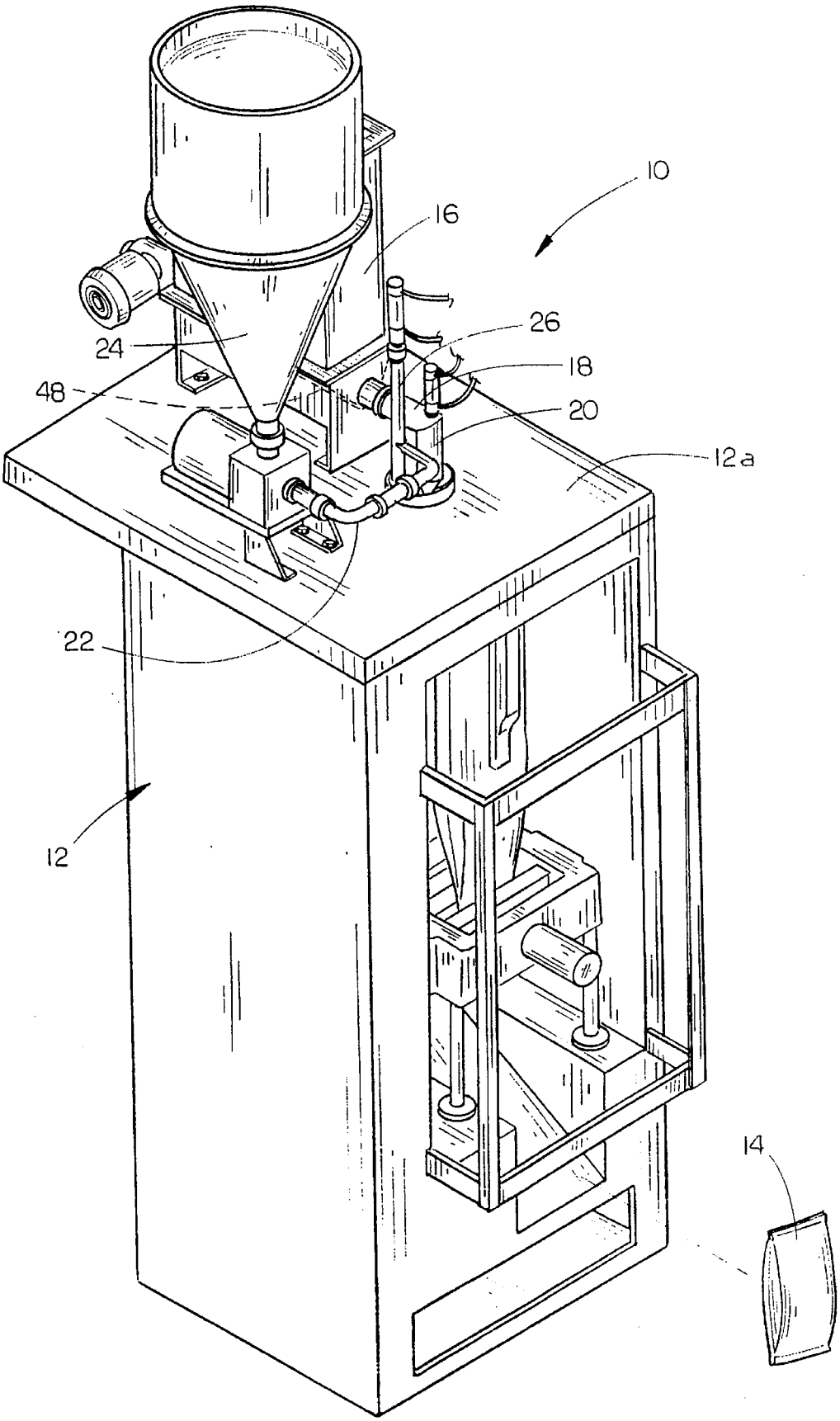
FIG. 1 is a perspective view of a gel pack packaging machine having the dispensing apparatus of the present invention installed thereon.

Referring now to the drawings, in which similar or corresponding parts are identified with the same reference numeral, and more particularly to FIG. 1, the dispensing apparatus of the present invention is designated generally at 10, and is shown on a housing 12 utilized in the manufacture of a gel pack 14.

As shown in FIG. 1, dispensing apparatus 10 includes a hopper 16 supported on the top 12*a* of housing 12. Hopper 16 supplies the dry particulate material utilized in producing a gel pack 14. A horizontal feed tube 18 extends from hopper 16 to the upper end of the vertical dry tube 20 to supply the dry material to dry tube 20. A second feed tube 22 extends from the lower end of a tank 24 which houses a supply of liquid, to a wet tube 26. Wet tube 26 is oriented vertically, and mounted parallel to dry tube 20, to supply liquid to the dispensing apparatus 10.

Figure 2:
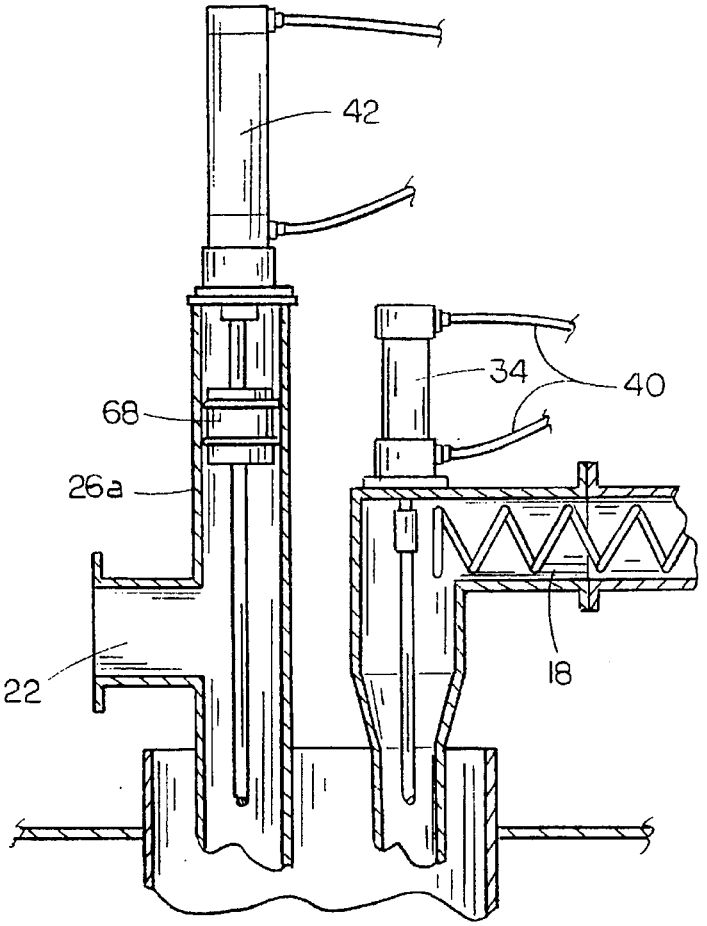
FIG. 2 is an enlarged vertical sectional view through the wet and dry tubes of the dispensing apparatus.
Figure 2:
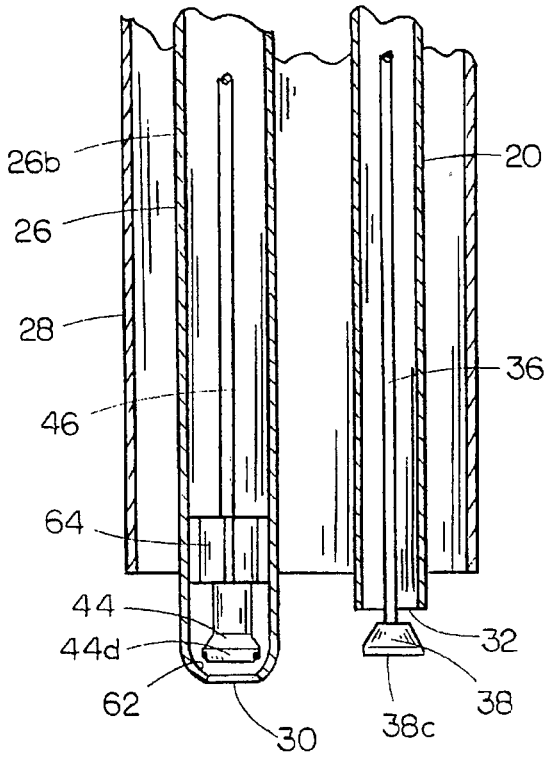

Referring now to FIG. 2, it can be seen that wet and dry tubes 26 and 20 extend through a central sleeve 28 upon which a plastic package is continuously formed, and into which the liquid and dry materials are dispensed through wet tube dispenser opening 30 and dry tube dispenser opening 32 in the lower ends of wet and dry tubes 26 and 20. A dual action pneumatic cylinder acts as an actuator 34 and is mounted on the upper end of dry tube 20. A plunger rod 36 extends from actuator 34 centrally through dry tube 20 to a plug 38 located at the lower end of plunger rod 36. Actuator 34 is pneumatically driven by air lines 40 to vertically move plug 38 between the open position shown in FIG. 2 and the closed position shown in FIG. 3.

Similarly, a second actuator 42 is mounted on the upper end of wet tube 26 and vertically moves a second plug 44 via a second plunger rod 46 extending through wet tube 26.

Figure 4:
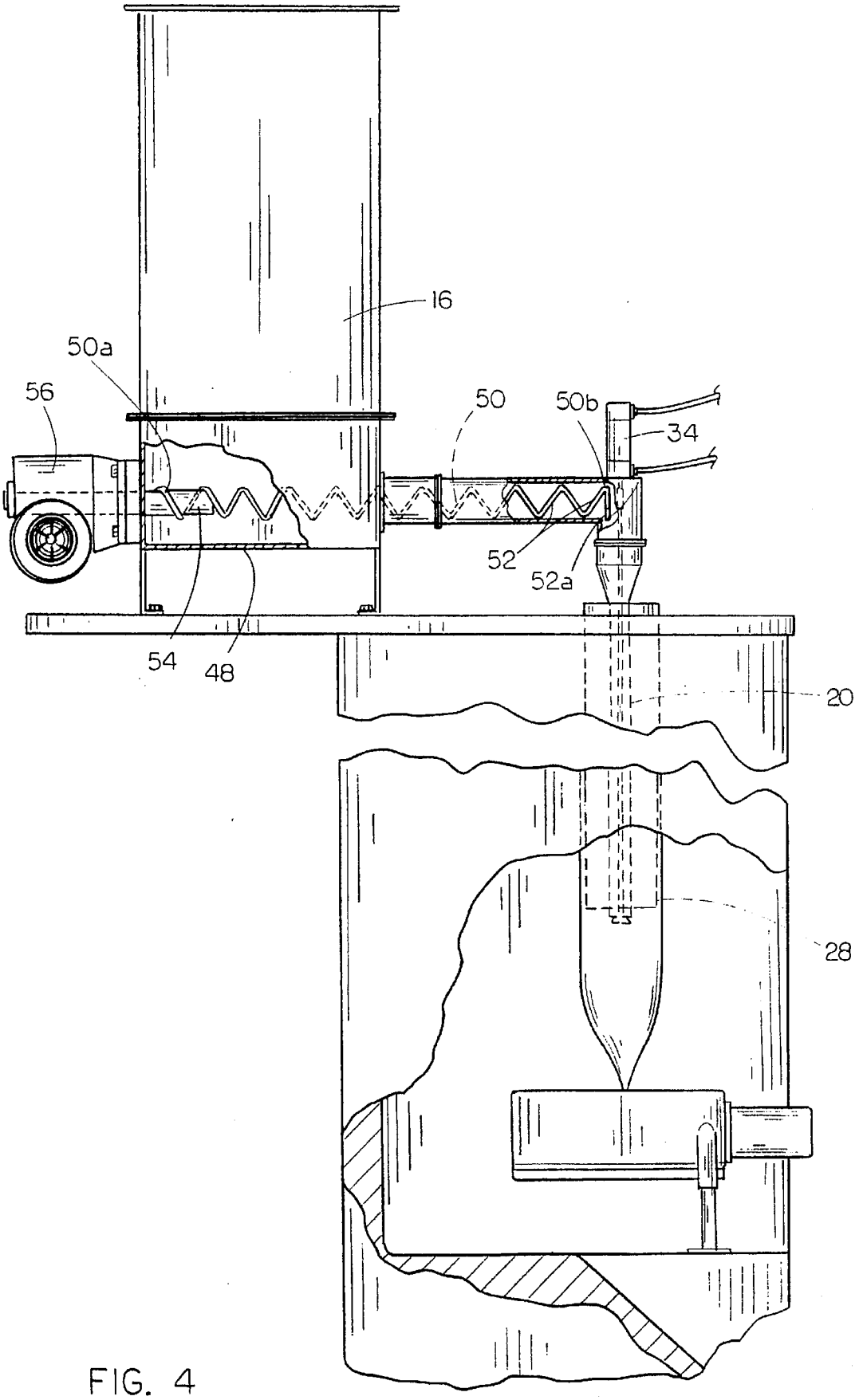
FIG. 4 is a side elevational view of the packaging machine with portions broken away for clarity.

As shown in FIG. 1, hopper 16 includes a generally V-shaped bottom wall 48, shown in hidden lines in FIG. 1. Bottom wall 48 is rounded to the same diameter as feed tube 18 such that an auger 50 fits rotatably along bottom wall 48 and within feed tube 18, as shown in FIG. 4. Auger 50 is preferably formed of a single stainless steel wire bent into a helical form with a uniform diameter. Auger 50 includes a plurality of individual coils 52, each coil oriented at a uniform pitch. The upstream end 50*a* of auger 50 is attached to a drive shaft 54 of a motor 56. Thus, motor 56 rotates dry shaft 54, thereby rotating auger 52 coaxially within feed tube 18 to move dry particulate material from hopper 16 to dry tube 20. The last coil 52*a* at the downstream end 50*b* of auger 50 has at least a semicircular portion thereof modified in pitch to a vertical plane orthogonal to the rotational axis of auger 50. End coil 52*a* thereby serves to prevent dry material from being dispensed into dry tube 20 between cycles of actuator 34. The inventors have found that use of a constant pitch for last coil 52*a* would permit small portions of dry material to fall into dry tube 20, beyond the predetermined amount carried between coils 52. Without a precise measurement of dry material into dry tube 20, the results achieved in the gel pack would not be consistent.

Figure 3:
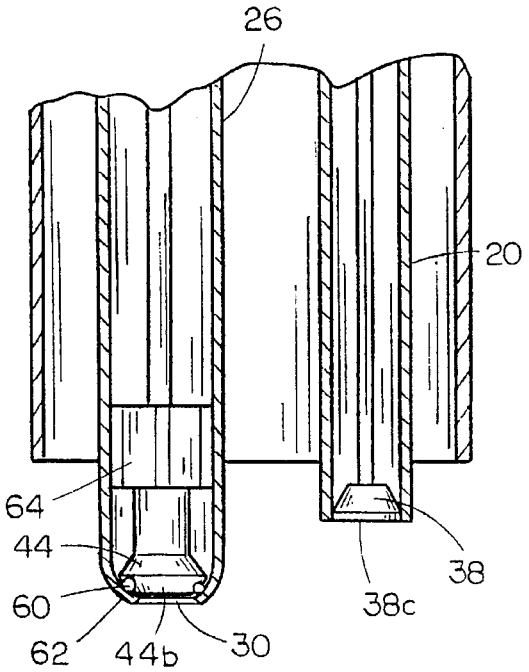
FIG. 3 is a view similar to FIG. 2, but with the plugs of the wet and dry tubes moved to a closed position.
Figure 5:
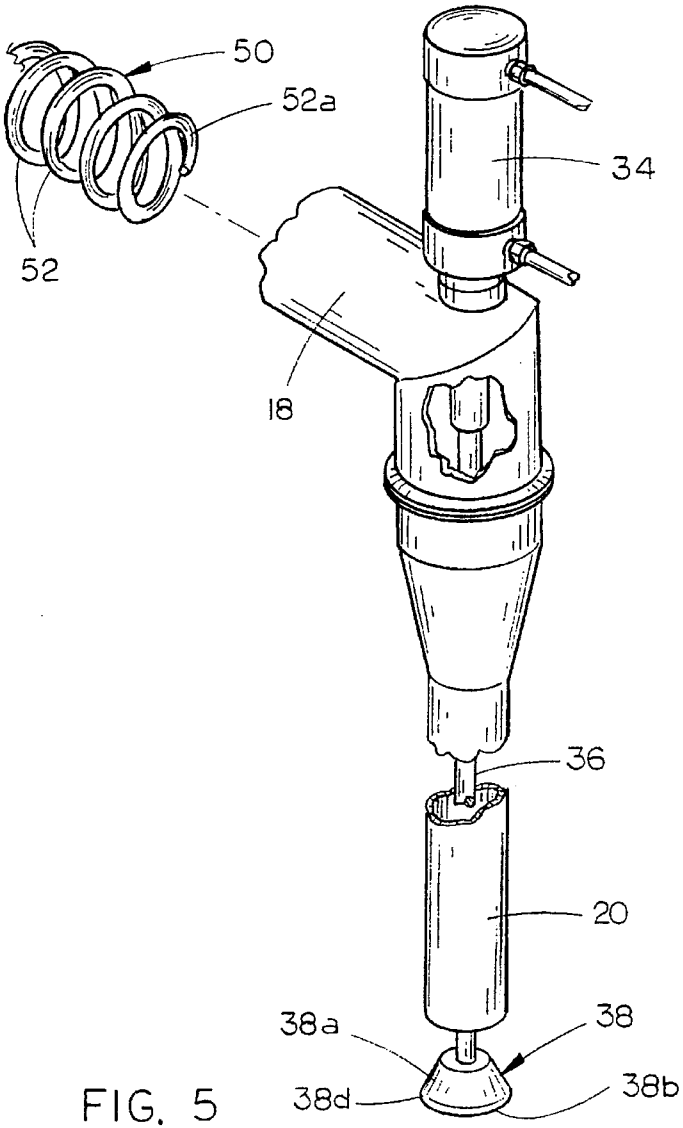
FIG. 5 is an exploded perspective view of the upper end of the dry tube, with the drive auger projecting from the feed tube.

Referring now to FIG. 5, plug 38 of dry tube 20 has a generally conical upper portion 38*a* with a lower diameter 38*d* slightly less than the inner diameter of dry tube 20 such that the lower end 38*b* will fit snugly within dry tube 20, in a closed position, as shown in FIG. 3. Plug 38 has a flat bottom surface 38*c* which moves to a position flush with the lower end of dry tube 20. Thus, when dry tube 20 is closed, with plug 38 moved upwardly into the lower end of dry tube 20 any liquid around the exterior of the tube will not contact an interior surface of dry tube 20. Moisture on an interior surface of dry tube 20 causes clumping or caking of the dry particulate material, thereby preventing effective and efficient dispensing of the dry material.

Figure 6:
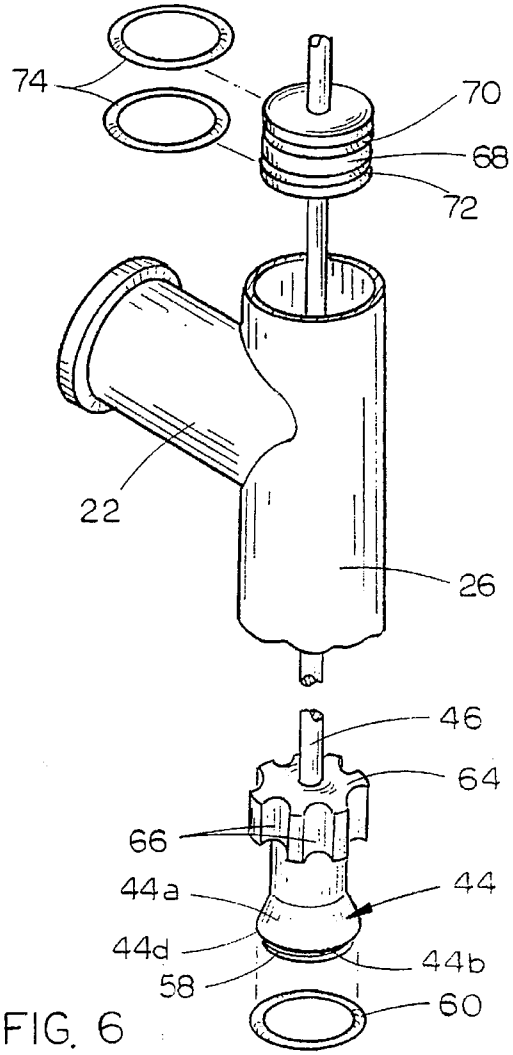
FIG. 6 is an exploded perspective view of the wet tube.

Referring now to FIGS. 3 and 6, second plug 44 includes a conical upper portion 44*a*, with the largest diameter 44*d* less than the interior diameter of wet tube 26, to permit liquid to flow around the conical diameter 44*d* when plug 44 is in the open position, shown in FIG. 2. Plug 44 includes a general convex lower portion 44*b* having an annular groove 58 formed therearound which receives an O-ring 60 thereon. As shown in FIG. 2, the lower end of wet tube 26 has an inwardly directed generally concave wall 62 corresponding with the shape of lower portion 44*b* of plug 44. As shown in FIG. 3, the outer diameter 44*d* of plug 44 is greater than the diameter of dispensing opening 30 such that downward movement of plunger rod 46 will cause O-ring 60 to be placed in sealed contact with concave wall 62. Thus, a positive liquid seal is formed when plug 44 is in the closed position.

In order to ensure direct and uniform contact of O-ring 60 with concave wall 62, a guide member 64 is affixed to plunger rod 46 immediately above plug 44. As shown in FIG. 6, guide member 64 is a generally cylindrical body having a plurality of vertically oriented flutes 66 formed around the exterior surface to permit fluid flow past guide member 64.

As shown in FIG. 2, feed tube 22 for wet tube 26 joins wet tube 26 spaced below the upper end thereof, thereby dividing wet tube 26 into an upper tube 26*a* and a lower tube 26*b*. A water stop 68 is mounted on plunger rod 46 within upper tube 26*a* of wet tube 26 in order to prevent liquid from traveling upward to the other end of wet tube 26. As shown in FIG. 6, water stop 68 is a generally cylindrical body having a pair of spaced apart annular grooves 70 and 72 therearound. A pair of O-rings 74 are mounted in grooves 70 and 72 to form a seal between water stop 68 and the inner diameter of wet tube 26, as shown in FIG. 2.

In operation, a very specific sequence of events is utilized to form the desired chemical compound within a package. Initially, an open ended container is formed at the lower end of sleeve 28, with the lower ends of wet and dry tubes 26 and 20 projecting downwardly from the lower end of sleeve 28, as shown in FIG. 2. It should be noted that wet tube 26 projects vertically downwardly farther than dry tube 20 such that liquid dispensed from wet tube 26 will not spray on the lower end of dry tube 20.

Once a container is positioned below wet and dry tubes 26 and 20, during which both plugs 44 and 38 maintain the tubes in a closed condition, the dispensing apparatus 10 will run through a dispensing cycle. The dispensing cycle includes the initial step of actuation of actuator 34 to move plug 38 to an open condition, shown in FIG. 2, and then the activation of motor 56 to rotate auger 50 and dispense a predetermined amount of dry particulate material into the upper end of dry tube 20, as shown in FIG. 4. The dry particulate material will fall through tube 20 and out through opening 32 into the container, as shown in FIG. 2. Actuator 34 then raises plug 38 to close dry tube 20.

Actuator 42 is activated to move plug 44 to an open position only after plug 38 has moved to the closed position in dry tube 20. Once wet tube 26 is open, liquid within the wet tube will be dispensed through opening 30 until actuator 42 again closes opening 30 with plug 44. The amount of time which opening 30 remains open meters the amount of liquid dispensed within the container.

The container is then sealed and removed from sleeve 28, and a subsequent container is formed at the bottom end thereof in preparation for another dispensing cycle.

Whereas the invention has been shown and described in connection with the preferred embodiment thereof, many modifications, substitutions and additions may be made which are within the intended broad scope of the appended claims.

We claim:

1. Dispensing apparatus, comprising:

a vertical tube having upper and lower ends, and a dispensing opening formed in the lower end thereof;

a plug operably mounted in the dispensing opening for movement between an open position, permitting the flow of material from the dispensing opening, and a closed position, blocking the flow of material from the tube;

a generally horizontal feed tube connected at a downstream end to the upper end of a vertical tube and communicating therewith such that material in the feed tube will flow into the vertical tube for dispensing therefrom;

said feed tube having an upstream end connected to a hopper and communicating therewith;

means in said feed tube for moving product within the hopper to said vertical tube; and an actuator mounted on said vertical tube and operably connected to said plug to selectively move the plug between the open and closed positions.

2. The dispensing apparatus of claim 1, wherein said dispensing opening is a vertically oriented aperture, and wherein said plug is operably mounted for vertical movement into and out of said aperture.

3. The dispensing apparatus of claim 2, wherein said actuator is mounted on the upper end of said vertical tube and located directly vertically above the plug, and further comprising a plunger rod extending with said vertical tube connecting said actuator to said plug.

4. The dispensing apparatus of claim 2, wherein said plug has a generally conical upper portion and oriented coaxially with said tube, with an upper end diameter less than a lower end diameter, and a lower end diameter corresponding to a diameter of the dispensing opening to seal the dispensing opening when located in the closed position.

5. The dispensing apparatus of claim 4, wherein said plug has a flat bottom surface orthogonal to the axis of the conical portion, and wherein the plug bottom surface is generally flush with the lower end of the vertical tube when the plug is in the closed position.

6. The dispensing apparatus of claim 1, wherein said means for moving product within the feed tube includes an auger rotatably mounted within the hopper and feed tube, having a free end located at the juncture of the feed tube with the vertical tube, and a drive end extending outwardly from the hopper, and a drive motor attached to the drive end of the auger for selectively and adjustably rotating the auger to convey product from the hopper to the vertical tube.

7. The dispensing apparatus of claim 6, further comprising a central control apparatus connected to said drive motor and to said vertical tube actuator, to coordinate the movement of product from the hopper to the vertical tube with the opening and closing of the plug.

8. The dispensing apparatus of claim 6, wherein said auger includes a wire formed into a uniform diameter helical shape with an outer diameter slightly less than the inner diameter of the feed tube, and forming a plurality of interconnected coils having a uniform pitch.

9. The dispensing apparatus of claim 8, wherein a last coil at the free end of the auger has at least a semicircular are formed in a vertical plane orthogonal to the rotational axis of the auger.

10. The dispensing apparatus of claim 1, wherein said hopper contains a dry product and the first vertical tube dispenses said dry product from the dispensing opening, and further comprising:

a second vertical tube having upper and lower ends, mounted adjacent the first tube and parallel therewith, the lower end of the second tube projecting vertically downwardly beyond the lower end of the first tube;

a dispensing opening formed in the lower end of the second vertical tube;

a plug operably mounted in the dispensing opening for movement between an open position, permitting the flow of material from the dispensing opening, and a closed position, blocking the flow of material from the tube;

a second feed tube connected at a downstream end to the second vertical tube and communicating therewith;

said second feed tube having an upstream end connected to a tank and communicating therewith;

means connected to the second feed tube for moving product from the tank therethrough to the second vertical tube; and an actuator mounted on said second vertical tube and operably connected to the second tube plug to selectively move the plug between the open and closed positions.

11. The dispensing apparatus of claim 10, wherein said second tube dispensing opening is a vertically-oriented aperture, and wherein said second tube plug is operably mounted for vertical movement into and out of said second tube aperture.

12. The dispensing apparatus of claim 11, wherein said second tube plug actuator is mounted on the upper end of the second tube and located directly vertically above the second tube plug, and further comprising a plunger rod extending within said second tube and connecting the second actuator to the second plug.

13. The dispensing apparatus of claim 12, wherein said hopper includes a supply of dry, particulate material, wherein said tank includes a supply of liquid, wherein said first plug forms a seal against flow of the dry particulate material when in the closed position, and wherein the second plug forms a liquid seal when in the closed position.

14. The dispensing apparatus of claim 13, wherein said second plug includes:

a generally conical upper portion oriented coaxially with the second tube, having an upper end diameter less than a diameter of a lower end of the conical portion;

a generally convex lower portion forming a plug bottom; and wherein said second tube lower end has an inwardly directed concave wall around the dispensing opening, corresponding with the convex lower portion of the plug bottom.

15. The dispensing apparatus of claim 14, wherein said second plug lower portion has an annular seal ring mounted thereon forming a liquid seal with the concave wall when the second plug is in the closed position.

16. The dispensing apparatus of claim 13, further comprising a guide member mounted on the second tube plunger rod adjacent the second plug, for guiding the second plug vertically and coaxially within the second tube during movement between the open and closed positions.

17. The dispensing apparatus of claim 16, wherein said guide member includes a generally cylindrical body having an outer diameter slightly less than the inner diameter of the second tube, said guide member body having an outer wall surface with a plurality of vertical flutes formed therein permitting flow of liquid past the guide member within the second tube.

18. The dispensing apparatus of claim 13, wherein said second feed tube is connected to the second tube spaced below the upper end of the second tube, dividing said second tube into upper and lower tube portions, said second tube plunger rod having a water stop affixed thereto for movement therewith and located within the second tube upper tube portion to prevent liquid from passing the water stop.

19. The dispensing apparatus of claim 18, wherein said water stop includes a generally cylindrical body mounted coaxially on the second tube plunger rod, with a pair of vertically spaced apart O-rings affixed to the water surface in slidable sealed contact with the second tube inner diameter.

* * * * *